US011684179B2

(12) United States Patent
Goppion

(10) Patent No.: US 11,684,179 B2
(45) Date of Patent: Jun. 27, 2023

(54) MUSEUM SHOWCASE DIVIDED INTO MODULES

(71) Applicant: GOPPION S.p.A., Trezzano Sul Naviglio (IT)

(72) Inventor: Alessandro Goppion, Milan (IT)

(73) Assignee: GOPPION S.p.A.

( * ) Notice: Subject to any disclaimer, the term of this patent is extended or adjusted under 35 U.S.C. 154(b) by 0 days.

(21) Appl. No.: 17/239,899

(22) Filed: Apr. 26, 2021

(65) Prior Publication Data

US 2021/0330093 A1 Oct. 28, 2021

(30) Foreign Application Priority Data

Apr. 27, 2020 (IT) ..... 102020000009097

(51) Int. Cl.
*A47F 3/00* (2006.01)

(52) U.S. Cl.
CPC ..... *A47F 3/004* (2013.01); *A47F 3/002* (2013.01); *A47F 3/005* (2013.01)

(58) Field of Classification Search
CPC ..... A47F 3/002; A47F 3/004; A47F 3/005
See application file for complete search history.

(56) References Cited

U.S. PATENT DOCUMENTS

| | | | | |
|---|---|---|---|---|
| 463,932 | A | 11/1891 | Allison | |
| 670,404 | A * | 3/1901 | Davis | 312/114 |
| 5,069,512 | A * | 12/1991 | Sykes | E06B 5/006 312/139.2 |
| 9,345,341 | B2 * | 5/2016 | Goppion | A47B 45/00 |
| 2009/0102331 | A1 * | 4/2009 | Goppion | A47F 3/001 312/138.1 |
| 2010/0127603 | A1 | 5/2010 | Hahn | |

FOREIGN PATENT DOCUMENTS

EP 2782481 A1 10/2014

* cited by examiner

*Primary Examiner* — James O Hansen
(74) *Attorney, Agent, or Firm* — Hasch Blackwell LLP

(57) ABSTRACT

The museum showcase includes a base, a horizontal guide system placed along a sliding direction, and a case mounted on the horizontal guide system; the case is divided into at least two modules and each module comprises two vertical side walls connected to an upper horizontal top panel and to a lower horizontal bottom; each module is mounted on the horizontal guide system to slide in direction (A); the modules each comprise two end modules and each end module includes a vertical end wall, the vertical end walls being connected to the vertical side walls, to the top panel and to the bottom in the respective module (21). An abutment profile is on each of the modules, that is directed towards another adjacent module and extends at a free edge of the bottom, the top panel and the vertical side walls; and a single exhibiting plane.

14 Claims, 4 Drawing Sheets

MUSEUM SHOWCASE DIVIDED INTO MODULES

CROSS REFERENCE

This application claims the priority of, and expressly incorporates by reference herein the entire disclosure of, Italian Patent Application No. 102020000009097, filed Apr. 27, 2020.

TECHNICAL FIELD

The present invention relates to a museum showcase, that is a showcase for preserving and displaying objects, such as typically artworks, cultural heritage objects or in any case delicate objects, in museums, exhibitions and the like.

BACKGROUND OF THE DISCLOSURE

In the following, reference will be made to museum showcases, although sometimes the term showcase alone will be used.

Museum showcases must therefore meet requirements of various type, in relation to preservation and integrity of the exhibits. In addition, these showcases must of course guarantee the best visibility for the exhibits.

In addition, museum showcases are increasingly made in very large sizes, both to accommodate large objects and to ensure better possibility of enjoying the exhibits; for example, in the exhibition of collections or of series that comprise many objects, the placement of these objects in the same showcase facilitates the viewer's overall and comparative vision.

Especially when the showcase is very large, it becomes important for the those managing the museum space to be able to have easy access to the inside of the showcase, both to be able to place large-sized objects in it, and to be able to operate more comfortably for the arrangement of a large number of objects.

The need to facilitate access to the inside of the showcase is therefore always felt. On the other hand, it is still indispensable to be able to guarantee the necessary seal of the showcase, in order to be able to keep the objects inside it in the atmosphere provided for the best preservation thereof and protected from the external environment.

SUMMARY OF THE DISCLOSURE

Accordingly, the present invention relates to a museum showcase according to claim 1; preferred characteristics are reported in the dependent claims.

More particularly, the museum showcase comprises a base, a primary horizontal guide system placed on the base along a sliding direction A, and a case which encloses a single exhibition space and is mounted on the primary horizontal guide system; the case is divided into at least two modules, and each of the modules comprises two vertical side walls sealingly connected to an upper horizontal top panel and to a lower horizontal bottom; each module is mounted on the primary horizontal guide system so as to be slidable in the sliding direction A; said at least two modules comprise two end modules, and each end module further comprises a vertical end wall, the vertical end walls being sealingly connected to the vertical side walls, to the top panel and to the bottom in the respective module. The showcase then comprises an abutment profile on each of the modules, that is directed towards another adjacent module and extends at a free edge of the bottom, of the top panel and of the vertical side walls, and a single exhibiting plane extended within the case, above the bottom of the modules.

In this showcase, the case can be opened completely by division, moving its modules in the sliding direction so as to have easy access to the single exhibiting plane, from all directions: both from the sides and from above. The single exhibiting plane allows the arrangement of the objects on it, when the showcase is open; the arrangement of the objects is then maintained unchanged during the subsequent operations of closing and opening of the showcase. It should also be noted that the exhibiting plane is enclosed within the case, which is closed (sealingly) by butt coupling, along the abutment profiles of the modules. There is therefore no need to provide for sealing systems between the modules and the base, which are complex as to construction and of limited effectiveness due to the relative sliding between the modules and the base.

Preferably, the showcase comprises a secondary horizontal guide system, placed between the single exhibiting plane and the bottom of the modules and extended in the same sliding direction as the primary horizontal guide system.

This expedient allows the modules of the case to slide freely with respect to the exhibiting plane during the opening and closing of the showcase.

Preferably, said at least two modules further comprise at least an intermediate module without vertical end walls, and comprising two abutment profiles, extended along the two free edges of the bottom, of the top panel and of the vertical side walls.

The use of one or more intermediate modules allows implementation of showcases of even very large size; the easy access to the inside of the showcase is guaranteed by the possibility of moving each of the modules in the sliding direction, in order to free the access to the various areas of the exhibiting plane, as needed.

Preferably, the museum showcase comprises for each pair of adjacent modules at least a sealing gasket, extended as a ring along one of the abutment profiles of the two adjacent modules. Thanks to the configuration of the showcase, the butt seal along the abutment profiles is easily ensured by simple and effective ring-shaped seals.

Preferably, the showcase comprises a locking mechanism to lock a module against an adjacent module, thereby ensuring that the locked condition is maintained.

The movement of the modules on the primary horizontal guide system can be free: in this case, it is an operator who manually moves the modules to open or close the showcase, making them slide like trolleys to the right and/or left, as needed.

Preferably, especially in the case of very large and therefore heavy showcases, the showcase comprises a driving mechanism that is active on the primary horizontal guide system to move the modules along the sliding direction. This mechanism can be manual (e.g. crank), or motorised.

The showcase can be extended horizontally or vertically. In a showcase extended horizontally, in which in each module the vertical side walls have a height lower than the width and/or the length of the top surfaces and bottoms, the invention allows a great ease of opening and closing. In a showcase extended vertically, in which in each module the vertical side walls have a height greater than the width and/or the length of the top surfaces and bottoms, the invention allows a great opening and closing safety, thanks to the presence of the single exhibiting plane.

Preferably, depending on the shape and size of the showcase, and depending on the exhibits, the vertical side walls and/or the vertical end walls and/or the top panels are made of transparent material, preferably glass.

BRIEF DESCRIPTION OF THE DRAWINGS

Further features and advantages will best result from the following description of a showcase according to an embodiment of the invention, made with reference to the accompanying drawings.

In such drawings.

DETAILED DESCRIPTION

In the figures, numeral 10 is used to indicate a museum showcase as a whole; the showcase 10 is a showcase of the type extending horizontally, also known as a table showcase, but it is evident—as mentioned above—that the invention is also applicable to a showcase extending vertically.

Figure 1:
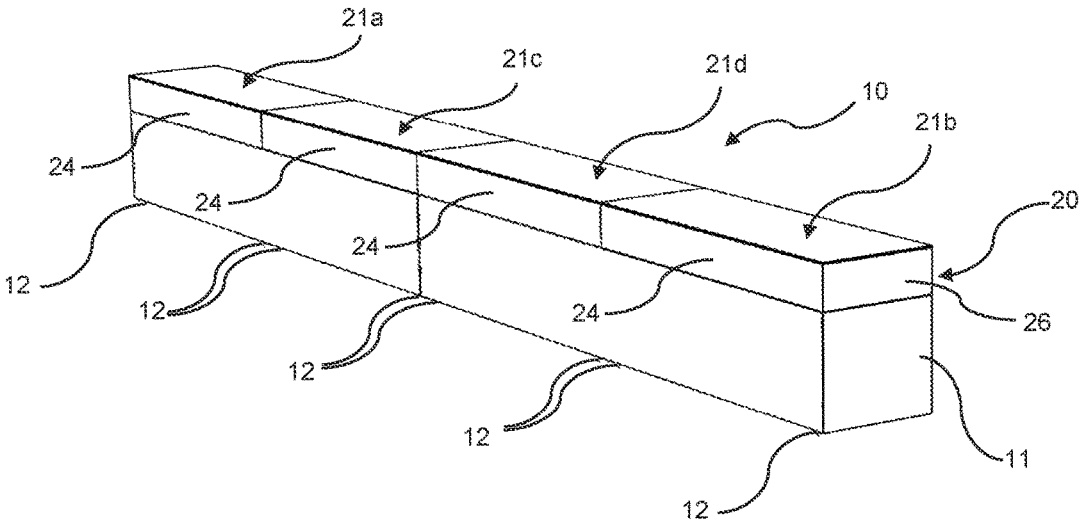
FIG. 1 is a perspective view of a showcase according to the invention, in a closed condition.
Figure 2:
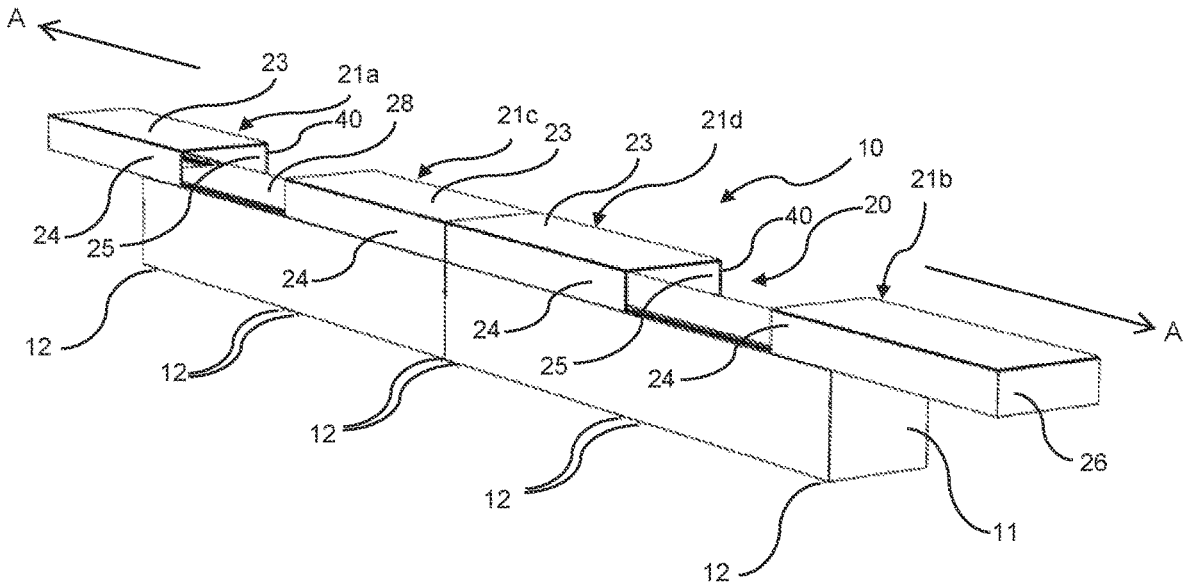
FIG. 2 is a perspective view of the showcase of FIG. 1, in a partially open condition.
Figure 3:
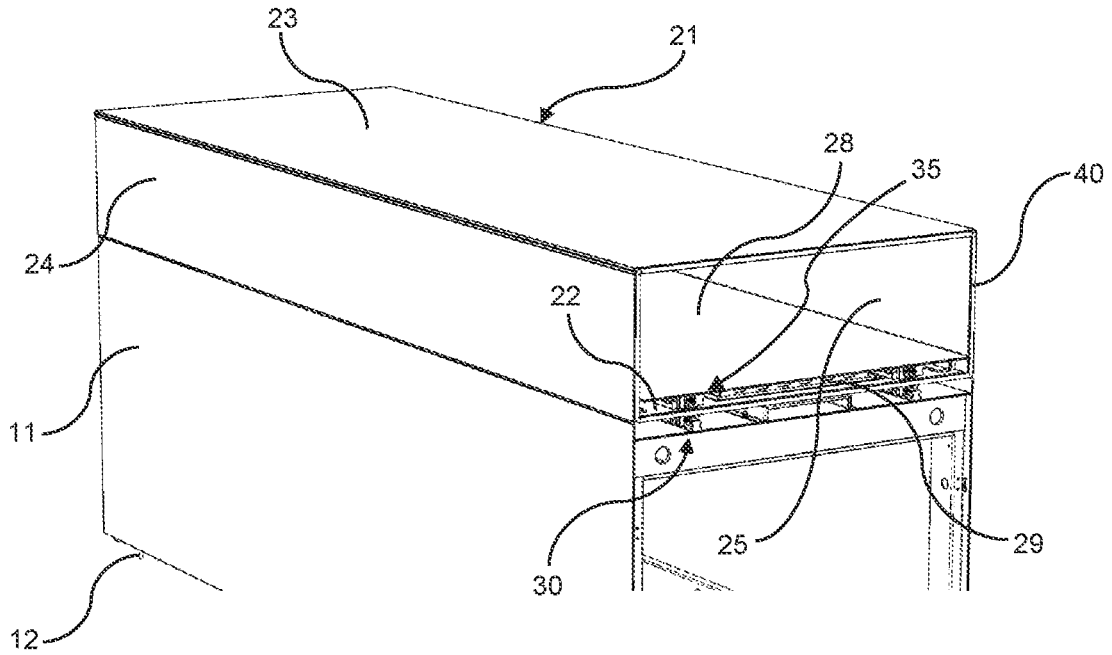
FIG. 3 is a partially cross-sectional perspective view of the open showcase of FIG. 2.
Figure 4:
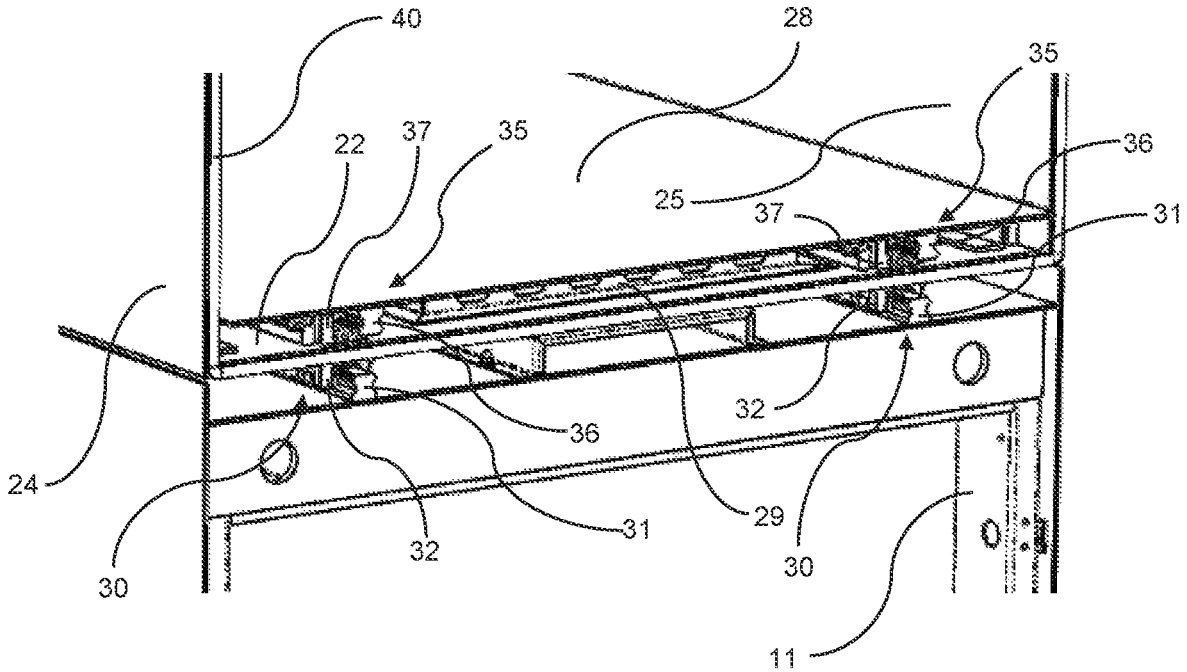
FIG. 4 is an enlarged view of part of FIG. 3.
Figure 5:
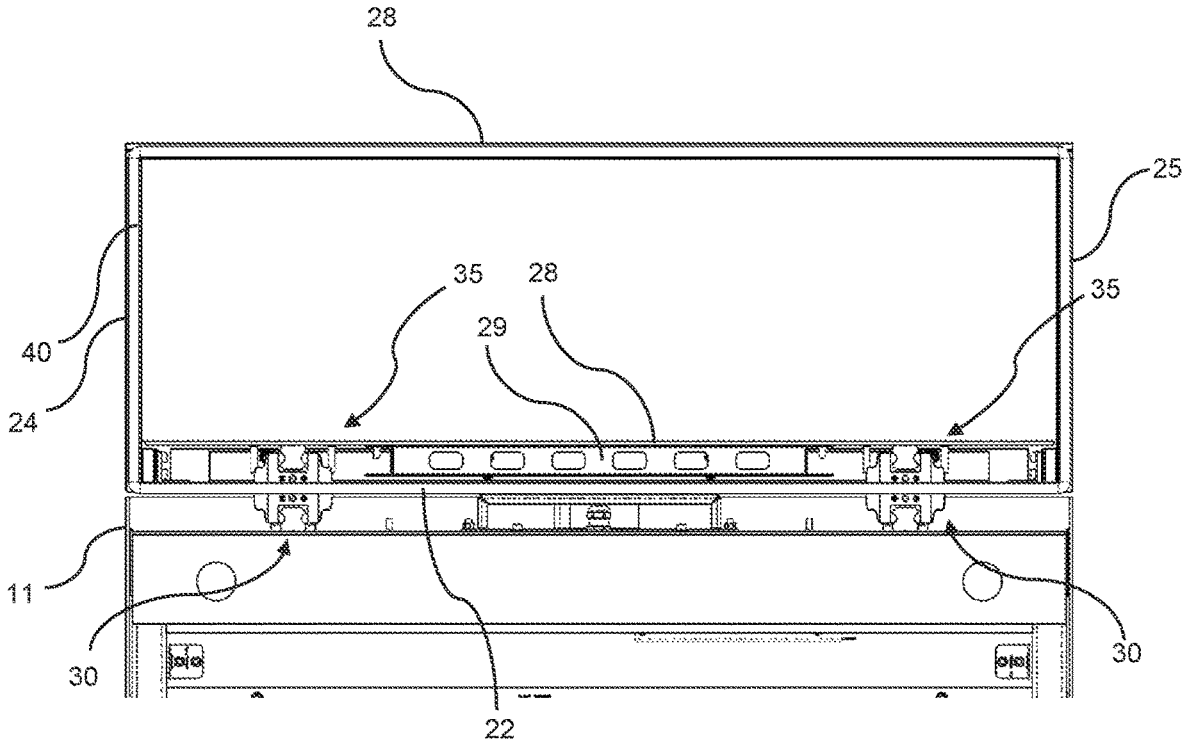
FIG. 5 is a cross-sectional view of the open showcase of FIG. 2.
Figure 6:
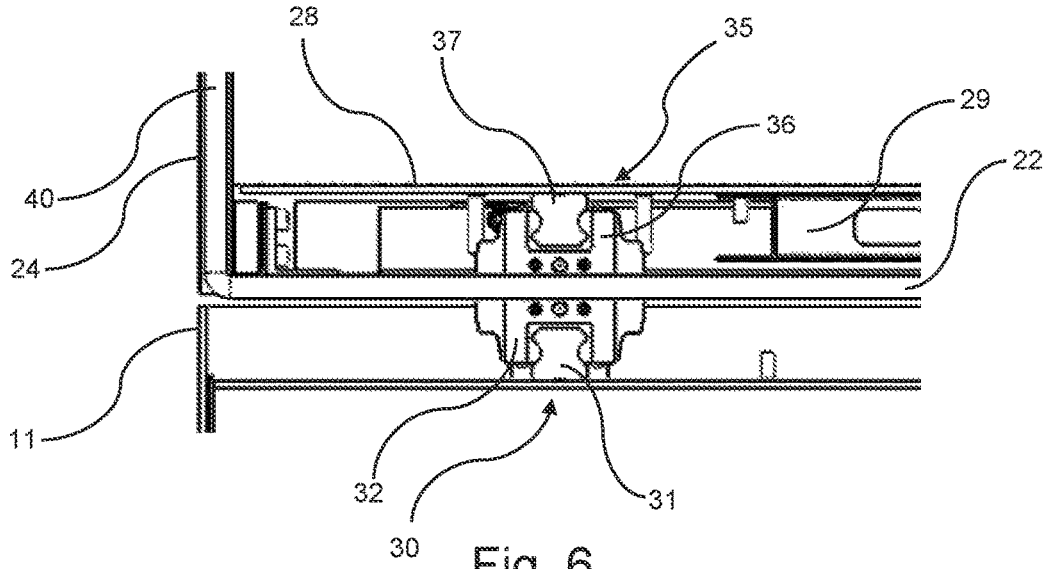
FIG. 6 is an enlarged view of part of FIG. 5.
Figure 7:
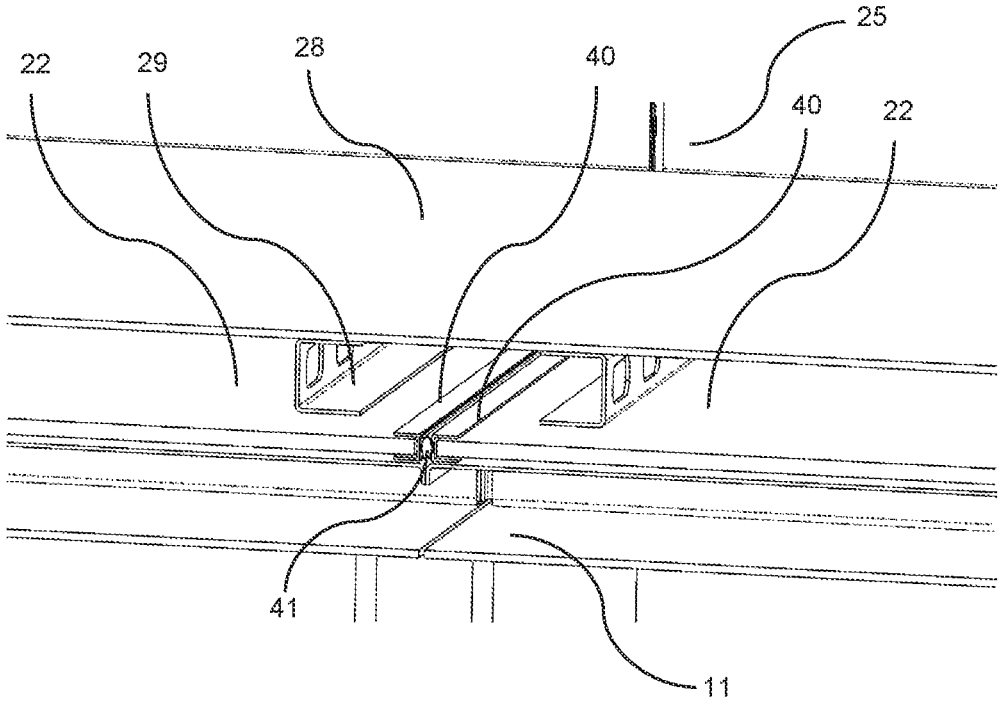
FIG. 7 is a partial perspective view, in longitudinal section, of the showcase of FIG. 1.

The showcase 10 comprises a base 11, supported or fixed to the ground by means of feet 12, surmounted by a case 20 in which the exhibition space is enclosed. The case 20 is formed with a plurality of side-by-side modules, in particular four modules: a left end module 21*a*, a right end module 21*b* and two intermediate modules 21*c* and 21*d*. The indication left or right is purely indicative, with reference to FIGS. 1 and 2.

The modules 21 each comprise a lower horizontal bottom 22, an upper horizontal top panel and two vertical side walls 24 and 25, which connect the bottom 22 to the top panel 23; more precisely, the vertical side walls are welded (for example by gluing) to the bottom 22 and to the top panel 23, so as to form a substantially tubular, airtight monolithic structure. The end modules 21*a* and 21*b* then also comprise two vertical end walls 26, which are in turn welded to respective bottoms 22, top panels 23 and vertical side walls 24 and 25. The bottoms 22 are made from a rigid, non-transparent panel, such as metal. On the other hand, the top panels 23 and the vertical walls 24, 25, 26 are preferably all (or at least part of them) made of glass.

All modules 21 are mounted above the base 11, aligned and slidable along a horizontal sliding direction A, which is longitudinal to the showcase 10. To this end, the showcase 10 comprises a primary horizontal guide system 30 between the base 11 and the case 20, on which the modules 21 are mounted. The primary horizontal guide system 30 comprises a pair of fixed rails 31, fixed above the base 11, and a pair of movable rails 32; the fixed rails 31 extend along the entire length of the showcase 10, while the movable rails 32 are divided into sections, respectively fixed below each of the bottoms 22 of the modules 21*a*, 21*b*, 21*c*, 21*d*. The rails 31 and 32 have low friction, for example with ball or roller bearings, preferably of the type in which the only possible relative movement is sliding, while the possibility of moving away in different directions is excluded; rails of this type are per se known and readily available on the market.

Thanks to the primary guide system 30, the modules 21 are free to slide on the base 11, like trolleys on a rail.

Each of the modules 21 faces adjacent modules with an abutment profile 40; the end modules 21*a* and 21*b* therefore have one abutment profile 40, while the intermediate modules 21*c* and 21*d* have two abutment profiles 40. Each abutment profile 40 develops along a rectangle at the free edges of the bottom 22, of the vertical side walls 24 and 25, and of the top panel 23. Preferably, each abutment profile 40 is formed by a frame, placed to protect the free edge of the bottom 22, of the vertical side walls 24 and 25 and of the top panel 23. Preferably, at least one of two facing abutment profiles 40 is provided with an annular, deformable gasket 41, for example of the O-ring type, so as to allow an airtight sealing between two modules 21 placed side by side.

The showcase 10 then comprises a single exhibiting plane 28, extended within the case 20 above the bottoms 22 of all modules 21. The exhibiting plane 28 is preferably made of a sheet of opaque material, such as metal, reinforced by transverse cross members 29 applied at the bottom, and extends along the entire length of the showcase 10 in the direction A.

The single exhibiting plane 28 is mounted floating on the bottoms 22 of the modules 21 by means of a secondary horizontal guide system 35, comprising a pair of fixed rails 36, fixed below the single exhibiting plane 28, and a pair of movable rails 37; the fixed rails 36 are extended along the entire length of the single exhibiting plane 28, while the movable rails 37 are divided into sections, respectively fixed above each of the bottoms 22 of the modules 21*a*, 21*b*, 21*c*, 21*d*. Similarly to what is provided for the primary horizontal guide system 30, the rails 36 and 37 have low friction, for example with ball or roller bearings, preferably of the type in which the only possible relative movement is sliding, while the possibility of moving away in different directions is excluded.

The showcase 10 can then be provided with locking mechanisms to lock two adjacent modules 21 together. Furthermore, the showcase 10 can be provided with a driving mechanism—manual or motorised—for the primary horizontal guide system 30. These features are per se known to the person skilled in the art, and are therefore not described in detail, nor shown on the drawings.

The operation of the showcase 10 is readily apparent from the foregoing. The opening thereof is achieved by moving one or more of the modules 21 along the primary horizontal guide system 30, until the desired access space is freed; the objects (or the single object) intended for display are then arranged on the single exhibiting plane 28. Once the arrangement has been completed, the showcase 10 is closed again by sliding the modules 21 so as to reconstitute the case 20, which is closed and sealed between module and module thanks to the abutment profiles 40 and the gaskets 41. It should be appreciated that the showcase 10 has a single large exhibition space with a single exhibiting plane 28, despite being made with modules 21 with relatively limited size.

During the opening and closing operations of the showcase 10, the single exhibiting plane does not interfere with the sliding movement of the modules 21, remaining floating above the bottoms 22, thanks to the secondary horizontal guide system 35. With the open showcase 10, the single exhibiting plane 28 may also be moved in turn along the direction A, within the limits of the position of the two end modules 21*a* and 21*b*, so as to facilitate the arrangement of objects thereon.

It should be noted that the two horizontal guide systems 30 and 35, with the respective rails 31, 32 and 36, 37, guarantee the solidity of the showcase 10 also during the opening and closing operations, and in particular in the positions of maximum opening. In fact, even if the modules 21*a* and 21*b* are cantilevered with respect to the base 11, the rails prevent them from overturning, since they are coupled to each other in such a way as to allow only sliding in the direction A and not moving away in the vertical direction. It should be noted in particular that the same single exhibiting plane 28 acts at this stage as a stiffening element against the weight that would tend to overturn the cantilevered modules 21*a* and 21*b*.

The showcase 10 lends itself to a modular construction. In fact, depending on the desired size, it is possible to build it with the necessary number of intermediate modules 21, without any particular construction complications. In particular, the single modules 21 remain unchanged, while only the base 11, the single exhibiting plane 28 and the primary and secondary horizontal guide systems 30 and 35 must be made in the desired length.

The invention claimed is:

1. A museum showcase comprising a base, a primary horizontal guide system placed on the base along a sliding direction A, and a case enclosing a single exhibition space and mounted on the primary horizontal guide system, wherein the case is divided into at least two modules, each of the modules comprising two vertical side walls, an upper horizontal top panel and a lower horizontal bottom, in each of the modules the two vertical side walls being sealingly connected to the upper horizontal top panel and to the lower horizontal bottom, wherein each module is mounted on the primary horizontal guide system so as to be slidable in the sliding direction A, wherein said at least two modules comprise two end modules, wherein each end module further comprises a vertical end wall, the vertical end walls being sealingly connected to the vertical side walls, to the top panel and to the bottom of the respective module, wherein each module further comprises an abutment profile, that is directed towards another adjacent module and extends at a free edge of the bottom, of the top panel and of the vertical side walls, and further comprising a single exhibiting plane extended within the case, above the bottom of the modules.

2. The museum showcase according to claim 1, comprising a secondary horizontal guide system, placed between the single exhibiting plane and the bottom of the modules and extended in the same sliding direction as the primary horizontal guide system.

3. The museum showcase according to claim 2, wherein said at least two modules further comprise at least an intermediate module without vertical end walls, and comprising two abutment profiles, extended along the two free edges of the bottom, of the top panel and of the vertical side walls.

4. The museum showcase according to claim 1, wherein said at least two modules further comprise at least an intermediate module without vertical end walls, and comprising two abutment profiles, extended along the two free edges of the bottom, of the top panel and of the vertical side walls.

5. The museum showcase according to claim 1, comprising for each pair of adjacent modules at least a sealing gasket, extended as a ring along one of the abutment profiles of the two adjacent modules.

6. The museum showcase according to claim 1, comprising a locking mechanism to lock a module against an adjacent module.

7. The museum showcase according to claim 1, comprising a driving mechanism that is active on the primary horizontal guide system to move the modules along the sliding direction.

8. The museum showcase according to claim 7, wherein the driving mechanism is motorised.

9. The museum showcase according to claim 1, extending horizontally, wherein in each module the vertical side walls have a height lower than the width and/or than the length of the top surfaces and bottoms.

10. The museum showcase according to claim 1, wherein the vertical side walls and/or the vertical end walls and/or the top panels are made of transparent material.

11. A museum showcase comprising a base, a primary horizontal guide system placed on the base along a sliding direction A, and a case enclosing a single exhibition space and mounted on the primary horizontal guide system, wherein the case is divided into at least two modules, each of the modules comprising two vertical side walls, an upper horizontal top panel and a lower horizontal bottom, in each of the modules the two vertical side walls being sealingly welded to the upper horizontal top panel and to the lower horizontal bottom, wherein each module is mounted on the primary horizontal guide system so as to be slidable in the sliding direction A, wherein said at least two modules comprise two end modules, wherein each end module further comprises a vertical end wall, the vertical end walls being sealingly connected to the vertical side walls, to the top panel and to the bottom of the respective module, wherein each module further comprises an abutment profile, that is directed towards another adjacent module and extends at a free edge of the bottom, of the top panel and of the vertical side walls, and further comprising a single exhibiting plane extended within the case, above the bottom of the modules.

12. A museum showcase comprising a base, a primary horizontal guide system placed on the base along a sliding direction A, and a case enclosing a single exhibition space and mounted on the primary horizontal guide system, wherein the case is divided into at least two modules, each of the modules comprising two vertical side walls, an upper horizontal top panel and a lower horizontal bottom, in each of the modules the two vertical side walls being sealingly connected to the upper horizontal top panel and to the lower horizontal bottom, the lower horizontal bottom extending between the two vertical side walls, wherein each module is mounted on the primary horizontal guide system so as to be slidable in the sliding direction A, wherein said at least two modules comprise two end modules, wherein each end module further comprises a vertical end wall, the vertical end walls being sealingly connected to the vertical side walls, to the top panel and to the bottom of the respective module, wherein each module further comprises an abutment profile, that is directed towards another adjacent module and extends at a free edge of the bottom, of the top panel and of the vertical side walls, and further comprising a single exhibiting plane extended within the case, above the bottom of the modules.

13. The museum showcase according to claim 12, wherein the lower horizontal bottom extends from a lower edge of one of the two vertical side walls to a lower edge of the other vertical side wall.

14. The museum showcase according to claim 12, wherein the lower horizontal bottom extends beneath an entire width of the single exhibiting plane perpendicular to the sliding direction A.

* * * * *